US010252409B2

(12) United States Patent
Pruiett et al.

(10) Patent No.: US 10,252,409 B2
(45) Date of Patent: Apr. 9, 2019

(54) MAGNETICALLY CLEANING FABRIC SURFACES

(71) Applicant: BISSELL Homecare, Inc., Grand Rapids, MI (US)

(72) Inventors: Jason W. Pruiett, Grand Rapids, MI (US); Jay M. Kellis, Grand Rapids, MI (US); Herbert J. Vanderbilt, Lowell, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 380 days.

(21) Appl. No.: 15/079,736

(22) Filed: Mar. 24, 2016

(65) Prior Publication Data

US 2016/0198924 A1 Jul. 14, 2016

Related U.S. Application Data

(63) Continuation of application No. 13/334,800, filed on Dec. 22, 2011.

(Continued)

(51) Int. Cl.

| | |
|---|---|
| ***A47L 13/41*** | (2006.01) |
| ***B25G 3/38*** | (2006.01) |
| ***A46B 3/20*** | (2006.01) |
| ***A46B 3/22*** | (2006.01) |
| ***A46B 13/00*** | (2006.01) |

(Continued)

(52) U.S. Cl.

CPC ..... *B25G 3/38* (2013.01); *A46B 3/20* (2013.01); *A46B 3/22* (2013.01); *A46B 13/008* (2013.01); *A46B 13/023* (2013.01); *A46B 13/04* (2013.01); *A46B 15/0026* (2013.01); *A47L 11/00* (2013.01); *A47L 11/34* (2013.01); *A47L 11/408* (2013.01); *A47L 11/4013* (2013.01);

(Continued)

(58) Field of Classification Search

CPC . A47L 13/40; A47L 13/41; E01H 1/14; A46B 15/0026; A61L 2400/12

USPC ..... 294/65.5; 209/215

See application file for complete search history.

(56) References Cited

U.S. PATENT DOCUMENTS 2,455,319 A * 11/1948 Stearns ..... A47L 11/22 15/3

2,654,480 A * 10/1953 Stem ..... A47L 13/41 15/3

(Continued)

FOREIGN PATENT DOCUMENTS

| | | |
|---|---|---|
| GB | 702905 | 1/1954 |
| JP | 09103395 A2 | 4/1997 |

OTHER PUBLICATIONS

JPH09103395—Machine Translation (Year: 1997).*

*Primary Examiner* — Marc Lorenzi

(74) *Attorney, Agent, or Firm* — McGarry Bair PC

(57) ABSTRACT

A magnetic cleaner distributes ferromagnetic cleaning particles to a surface to agglomerate dirt and dust, agitates the cleaning particles on the surface so that dirt particles adhere to the cleaning particles, and collects the dirt laden cleaning particles. A dispenser for holding and dispensing the ferromagnetic cleaning particles, an agitator to agitate the ferromagnetic particles on the surface, a magnetic collector for picking up ferromagnetic cleaning particles from the surface, and a dirt cup for collecting the ferromagnetic cleaning particles picked up by the collector are provided by the cleaner.

16 Claims, 4 Drawing Sheets

Related U.S. Application Data

(60) Provisional application No. 61/427,469, filed on Dec. 27, 2010.

(51) Int. Cl.

| | |
|---|---|
| ***A46B 13/02*** | (2006.01) |
| ***A46B 13/04*** | (2006.01) |
| ***A46B 15/00*** | (2006.01) |
| ***A47L 11/00*** | (2006.01) |
| ***A47L 11/34*** | (2006.01) |
| ***A47L 11/40*** | (2006.01) |
| *A46B 3/00* | (2006.01) |

(52) U.S. Cl.
CPC ..... *A47L 11/4036* (2013.01); *A46B 3/00* (2013.01); *A46B 2200/3033* (2013.01)

(56) References Cited

U.S. PATENT DOCUMENTS 2,693,279 A * 11/1954 Box ..... A47L 13/41 209/215
4,087,879 A 5/1978 Spence
4,158,575 A 6/1979 Townsend
6,113,169 A * 9/2000 Gohman ..... B03C 1/30 209/215
6,243,909 B1 * 6/2001 Graham ..... A47L 13/20 15/1.52
6,402,212 B1 6/2002 Hsiao
6,592,161 B1 * 7/2003 Hsiao ..... B25H 3/02 209/215
6,761,773 B1 7/2004 McKechnie et al.
2003/0007942 A1 1/2003 Koenig
2006/0288516 A1 * 12/2006 Sawalski ..... A47L 5/26 15/320
2007/0169710 A1 * 7/2007 Wang ..... A01K 1/01 119/173
2008/0096958 A1 4/2008 Takeuchi et al.
2011/0146720 A1 * 6/2011 Huffman ..... A47L 11/34 134/21
2011/0253055 A1 10/2011 Tang et al.

* cited by examiner

MAGNETICALLY CLEANING FABRIC SURFACES

CROSS-REFERENCE TO RELATED APPLICATIONS

This application is a continuation of U.S. patent application Ser. No. 13/334,800, filed Dec. 22, 2011, now abandoned, which claims the benefit of U.S. Provisional Patent Application No. 61/427,469, filed Dec. 27, 2010, both of which are incorporated herein by reference in their entirety.

BACKGROUND OF THE INVENTION

Field of the Invention

The present invention relates to cleaning fabric surface such a carpets and upholstery. In one of its aspects, the invention relates to an apparatus and method for dry extraction of dirt and dust particles from a fabric surface. In another of it aspects, the invention relates to an apparatus and method for deep cleaning of fabrics without liquid cleaning compositions. In yet another of its aspects, the invention relates to fabric cleaning with a ferromagnetic medium. In yet another aspect, the invention relates to ferromagnetic particles for use in dry cleaning of fabrics.

Description of the Related Art

Floor cleaners to remove unwanted ferrous materials from the surface to be cleaned are known. Known ferrous material cleaners can comprise one or more magnets disposed within a roller or rotating drum to pick up ferrous materials on the drum surface that are attracted to the one or more magnets by magnetic force. Such an apparatus can comprise a handle for pushing the magnetic cleaner attached to a foot assembly with one or more wheels or rollers for translating the magnetic cleaner over the surface to be cleaned. The foot assembly can contain the magnetic rotating drum for attracting magnetic materials, such as nails, screws, clips, metal filings, etc. and a compartment for collecting the materials that are attracted to the magnetic rotating drum. The magnets contained within the drum can be permanent magnets or electromagnets and a separator is provided for separating the materials from the surface of the drum so that the materials can be collected within the compartment.

Ferrous material cleaners are suitable for removing unwanted ferromagnetic materials from particles containing nickel, cobalt, chromium, iron, or alloys, composites, and intermetallics thereof from the surface to be cleaned.

U.S. Pat. Nos. 6,402,212 and 4,087,879, United Kingdom Patent No. GB702905 and Japanese Patent No. 09103395 disclose examples of apparatus suitable for picking up unwanted ferrous material from a surface to be cleaned and are incorporated herein by reference in their entirety. U.S. Pat. No. 6,761,773 discloses a method for controlling and removing dust and other fine particles in a material, such as a carpet or fine fabric material, comprising i) electrostatically charging carrier particles (for example by tribo-electric charging, induction charging or corona charging) in powder form to give the carrier particles a minimum charge to mass ratio of +/−1.times.10.sup.−4 C/kg, ii) delivering the electrostatically charged carrier particles to the material, whereby the dust and other fine particles in the material agglomerate with the charged carrier particles and iii) removing the resultant agglomerates from the material.

BRIEF DESCRIPTION OF THE INVENTION

According to the invention, a magnetic cleaner includes a housing comprising a handle assembly, a ferromagnetic cleaning particle dispenser for dispersing ferromagnetic cleaning particles from the front of the housing onto a surface to be cleaned, a ferromagnetic cleaning particle reservoir coupled to the ferromagnetic cleaning particle dispenser to selectively supply the ferromagnetic cleaning particle dispenser with ferromagnetic cleaning particles, a mechanical agitator for mechanically agitating the ferromagnetic cleaning particles dispersed onto the surface to be cleaned, a magnetic agitator for magnetically agitating the ferromagnetic cleaning particles dispersed onto the surface to be cleaned, wherein the magnetic agitator comprises an oscillating magnetic field to effect magnetic agitation of the ferromagnetic cleaning particles, a rotating magnetic drum emanating a magnetic field for attracting the ferromagnetic cleaning particles from the surface to be cleaned back to the magnetic cleaner, and a dirt cup for collecting the ferromagnetic cleaning particles attracted by the drum.

DESCRIPTION OF EMBODIMENTS OF THE INVENTION

Figure 1:
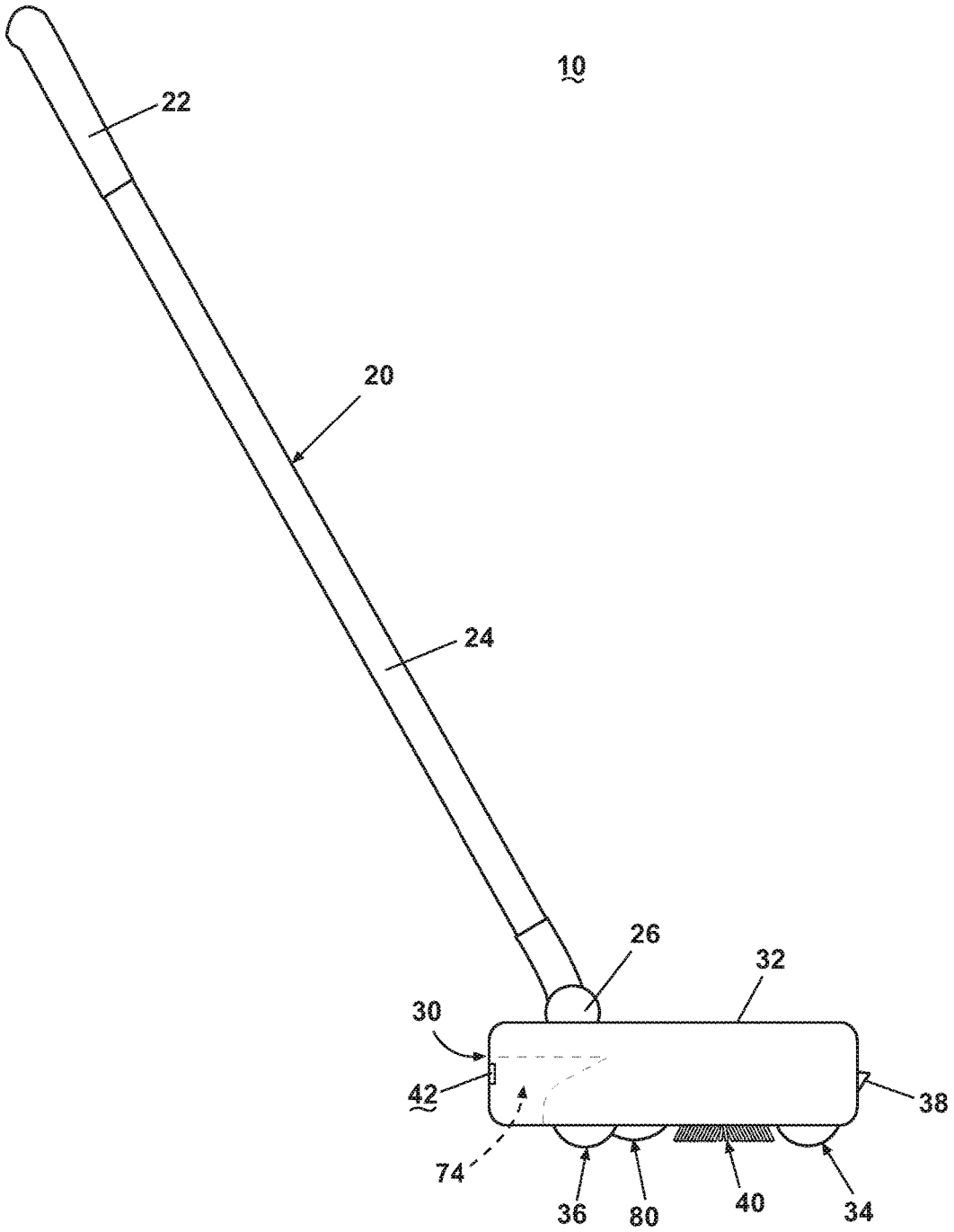
FIG. 1 is a side schematic view of a first embodiment of a magnetic cleaning apparatus according to the invention.

For purposes of description related to the figures, the terms "upper," "lower," "right," "left," "rear," "front," "vertical," "horizontal," and derivatives thereof shall relate to the invention as oriented in FIG. 1. However, it is to be understood that the invention can assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIG. 1, a magnetic cleaner 10 according to the invention comprises a housing which includes a handle assembly 20 and a foot assembly 30. The handle assembly 20 can be pivotally mounted to the foot assembly 30 by a swivel joint 26. The handle assembly comprises a handle shaft 24 and a handle grip 22 to provide a comfortable grip for a user while pushing and pulling the magnetic cleaner in forward and reverse directions. The foot assembly 30 comprises front wheels 34 and rear wheels 36 rotatably mounted to an inboard side of a housing 32 of the foot assembly 30 for translating the magnetic cleaner 10 over a surface to be cleaned. A ferromagnetic cleaning particle dispenser 38 is provided for dispersing ferromagnetic cleaning particles 54 from the front of the magnetic cleaner 10, an agitator assembly 40 for agitating the ferromagnetic cleaning particles 54, a rotating magnetic drum 80 emanating a magnetic field for attracting the ferromagnetic cleaning particles, and a removable dirt cup 74 for collecting dirt laden ferromagnetic cleaning particles. The removable dirt cup 74 comprises a hand grip 42 to enable separation of the dirt cup 74 from the foot assembly 30 for the purpose of emptying the dirt cup 74.

Figure 2A:
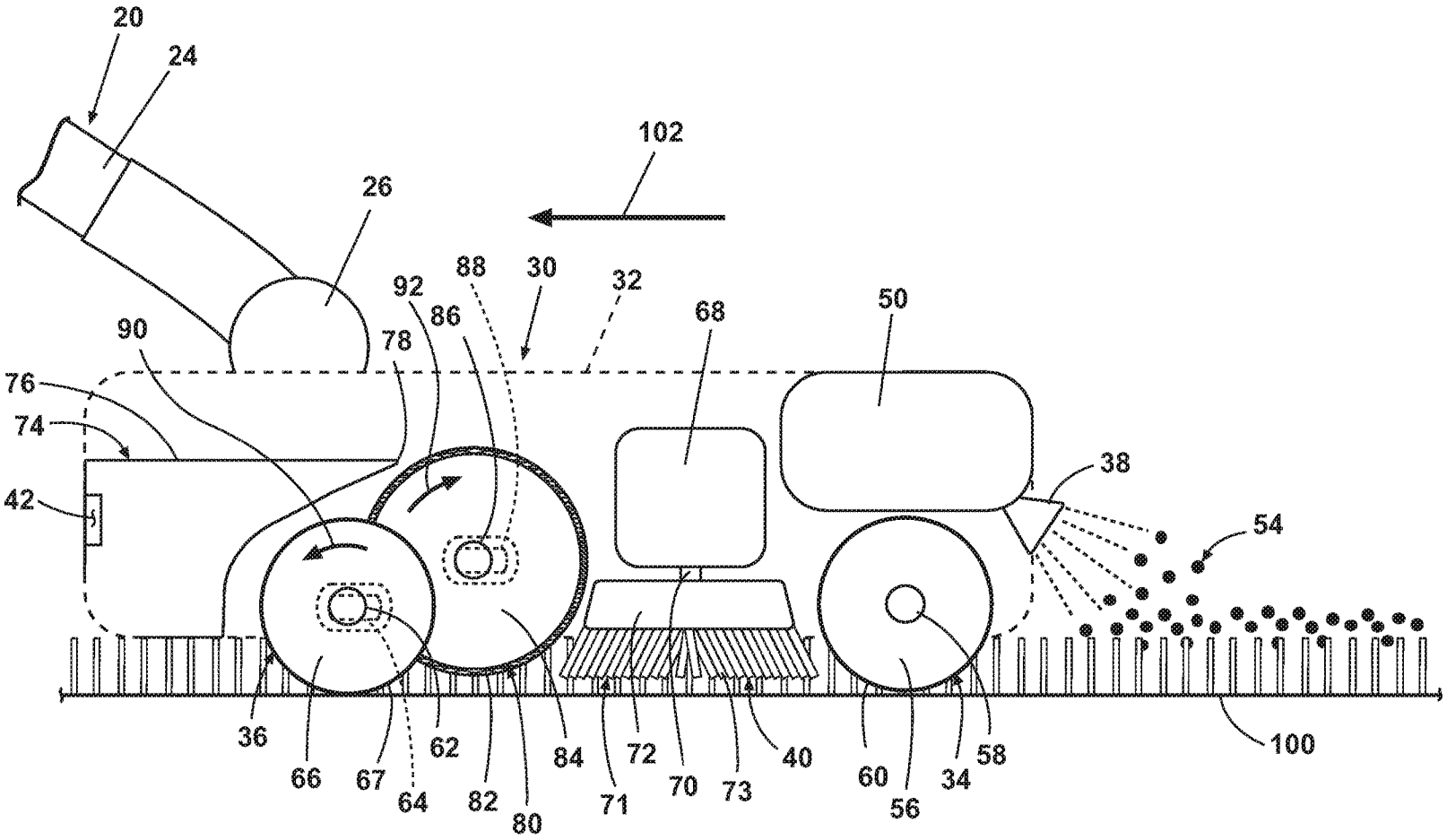
FIG. 2A is a side schematic view of the magnetic cleaning apparatus of FIG. 1 with part of the housing shown in dotted lines to show a magnetic drum and scraper mechanism.
Figure 2B:
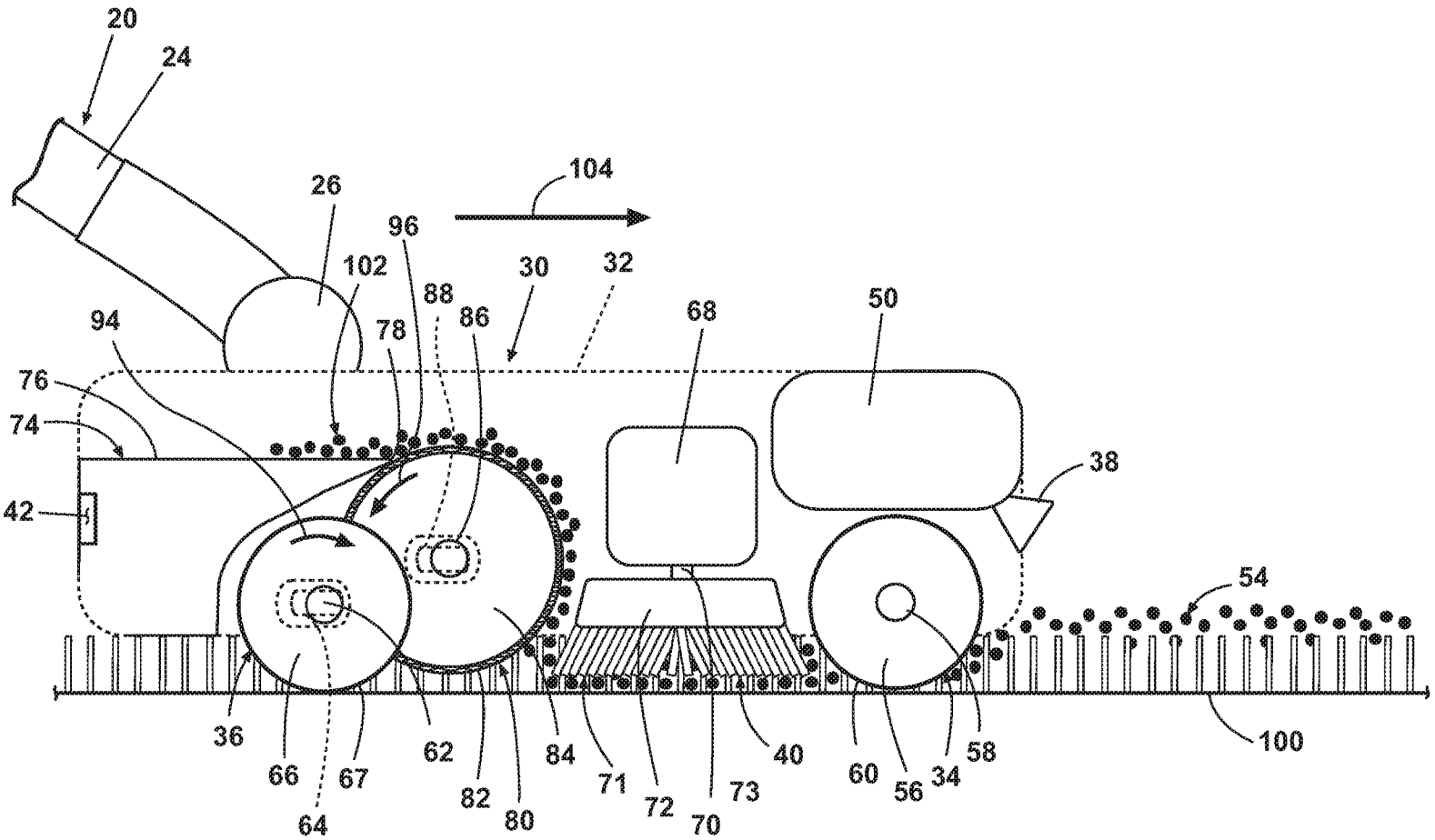
FIG. 2B is a side schematic view of the magnetic cleaning apparatus of FIGS. 1 and 2A with part of the housing shown in dotted lines to show the magnetic drum and scraper mechanism and the unit moving in a forward direction.

Referring now to FIGS. 2A and 2B, the foot assembly 30 with the housing 32 shown in dotted lines comprises a magnetic drum 80, a ferromagnetic cleaning particle reservoir 50 coupled to the ferromagnetic cleaning particle dispenser 38 to selectively supply the ferromagnetic cleaning particle dispenser 38 with ferromagnetic cleaning particles 54 for distribution on the surface 100, an agitator assembly 40 and a dirt cup 74. The agitator assembly 40 comprises a circular agitator brush 71 rotatable around a vertical axis with multiple bristles 73 tufted to a hub 72 and rotatably driven by a motor 68 through a connector 70. Although not apparent in the side view of FIG. 2A, the agitator brush 71 extends substantially the full width of the housing 32 of the foot assembly 30. Alternatively, a plurality of agitator brushes 71 can span the full width of the housing 32 of the foot assembly 30.

The front wheels 34 of the foot assembly 30 comprises a front wheel axle 58 for rotatably mounting the front wheels 34 to the housing 32, a front wheel sidewall 56, and a front wheel tread 60 comprising an elastomeric material with a high coefficient of static friction to promote better grip between the front wheel 34 and the surface 100 being cleaned. Likewise the rear wheels 36 comprise a rear wheel axle 62 for rotatably mounting the rear wheels 36 to the housing 32, a rear wheel sidewall 66, and a rear wheel tread 67 comprising an elastomeric material with a high coefficient of static friction to promote better grip between the rear wheels 36 and the surface 100 being cleaned. The axle 62 sits within a slotted mount hub 64 on the inboard side of the housing 32 to enable the rear wheels 36 to translate to a forward position (FIG. 2A) and a rearward position (FIG. 2B) depending on the direction, of movement of the magnetic cleaner 10. FIG. 2A illustrates the movement of the foot assembly 30 in a rearward direction and FIG. 2B illustrates the movement of the foot assembly in the forward direction. Although not apparent in the side view of FIG. 2A, front wheels 34 and the rear wheels 36 are each rotatably mounted at an inboard location on both the left and right sides of the foot assembly 30.

Continuing now with FIGS. 2A and 2B, the magnetic drum 80 is mounted on drum mount 86 for rotation within a slotted drum mount hub 88 on the inboard side of the housing 32 and includes drum sides 84 and a drum surface 82. The drum surface 82 comprises a cylindrical profile, although alternative shapes are contemplated, such as one having a plurality of planar faceted faces, such as a hexagonal or octagonal profile, for example. At least a portion of the drum surface 82 is magnetized to attract ferromagnetic materials, such as the ferromagnetic cleaning particles 54. The magnetic drum 80 is mechanically coupled with the rear wheels 36 to rotate the magnetic drum 80 with the rear wheels 36 when the rear wheels are in the rearward position as shown in FIG. 2B. Like the rear wheels 36, the magnetic drum 80 translates in a forward or rearward position within the slotted drum mount hub 88 based upon the direction in which the magnetic cleaner 10 is translated. Although not apparent in the side view of FIG. 2A, the magnetic drum extends substantially the full width of the housing 32 of the foot assembly 30. Alternatively, the magnetic drum 80 can be driven by an electric drive motor and drive train (not shown), which is a configuration similar to those for driving agitator brush rolls as is commonly known in the art.

The removable dirt cup 74 has a top opening 76 through which the dirt laden ferromagnetic cleaning particles 54 enter and are emptied from the removable dirt cup 74. A scraper 78 is mounted to the housing proximate the drum outer surface 82 for scraping the ferromagnetic cleaning particles 54 from the magnetic drum 80 as the drum rotates rearwardly as illustrated in FIG. 2B. A hand grip 42 is mounted on the dirt cup 74 for selectively removing the removable dirt cup 74 from the housing 32. Although not apparent in the side view of FIG. 2A, the scraper 78 extends substantially the full width of the housing 32 of the foot assembly 30.

Referring to FIG. 2A, when the magnetic cleaner 10 is pulled in a reverse direction as indicated by the arrow 102, the foot assembly 30 dispenses ferromagnetic cleaning particles 54 from the ferromagnetic cleaning particle reservoir 50 through the ferromagnetic cleaning particle dispenser 38 onto the surface to be cleaned 100. The ferromagnetic cleaning particles 54 can be sprayed on to the surface to be cleaned 100 at approximately a width equal to the width of the foot assembly 30. When pulled in a reverse direction 102, the rear wheel axle 62 slides to a forward position of the slotted mount hub 64. In so doing, the rear wheel 36, as well as the magnetic drum 80 is translated in a forward direction such that the magnetic drum is not in contact with the scraper 78. Additionally, as the magnetic cleaner 10 is pulled in the reverse direction 102 the rear wheel rotates in direction 90 and the magnetic drum rotates in direction 92. As a result, the drum may attract debris or ferromagnetic cleaning particles 54, but any debris or ferromagnetic cleaning particles 54 that may be attached to the magnetic drum 80 are not scraped by the scraper 78. The agitator assembly 40, and in particular the agitator brush 71 is in contact with portions of the surface to be cleaned 100.

Referring to FIG. 2B when the magnetic cleaner is moved in a forward direction as indicated by arrow 104, the magnetic drum 80 moves towards the scraper 78. Unlike the reverse direction 102, in the forward direction 104, the foot assembly 30 does not dispense ferromagnetic cleaning particles 54 from the ferromagnetic cleaning particle reservoir 50 onto the surface to be cleaned 100. When pushed in the forward direction 104, the rear wheels 36, as well as the magnetic drum 80 are translated in a rearward direction where the magnetic drum is in contact with the scraper 78. Additionally, as the magnetic cleaner 10 is pushed in a forward direction 104 the rear wheel rotates in direction 94 and the magnetic drum rotates in direction 96. As a result, any debris or ferromagnetic cleaning particles 54 that may be attached to the magnetic drum 80 is scraped by the scraper 78 and deposited in the removable dirt cup 74. While the magnetic cleaner 10 is maneuvered in a forward direction 104 over the surface to be cleaned 100, the agitator assembly 40, and in particular the agitator brush 71 is agitated by the motor 68 to work the cleaning particles 54 into the fibers of the fabric. At this point, the dirt from the surface to be cleaned 100 adheres either to the surface of the ferromagnetic cleaning particle 54 or within the body of the ferromagnetic cleaning particle 54. The agitation of the cleaning particles 54 by the agitator brush 71 promotes the agglomeration of dirt and debris on the cleaning surface on the ferromagnetic cleaning particles 54. As the magnetic drum 80 passes over the ferromagnetic cleaning particles 54, the ferromagnetic cleaning particles 54 with dirt attached thereto are attracted to the magnetic drum 80 and adhere to the magnetic drum 80 as it is translated over and rotates over the surface to be cleaned 100. The magnetic drum 80 rotates in a direction opposite the rotation of the rear wheel 36. The ferromagnetic cleaning particles 54 that adhere to the magnetic drum 80 are subsequently scraped off of the magnetic drum 80 by the scraper 78 that is in contact with the rotating magnetic drum 80 and collected in the removable dirt cup 74 through the top opening 76.

As the magnetic cleaner 10 is maneuvered over the surface to be cleaned 100 in a backward 102 and then forward 104 motion, the magnetic cleaner 10 first disperses ferromagnetic cleaning particles 54 during the backward movement and then agitates and collects the ferromagnetic cleaning particles 54 during the forward movement. When the removable dirt cup 74 is full of ferromagnetic cleaning particles 54 and entrained dirt, the removable dirt cup 74 can be removed using hand grip 42 to empty by inverting such that the cleaning particles can fall out through the top opening 76. Alternatively, the ferromagnetic cleaning particles 54 can be dispersed by hand from a separate container or shaker (not shown), independent from the magnetic cleaner 10. For example, a broadcast spreader or a shaker can be used to distribute the ferromagnetic cleaning particles 54 on the surface to be cleaned 100 and the magnetic cleaner 10 can be used to agitate and collect the dirt laden ferromagnetic cleaning particles 54.

Figure 3:
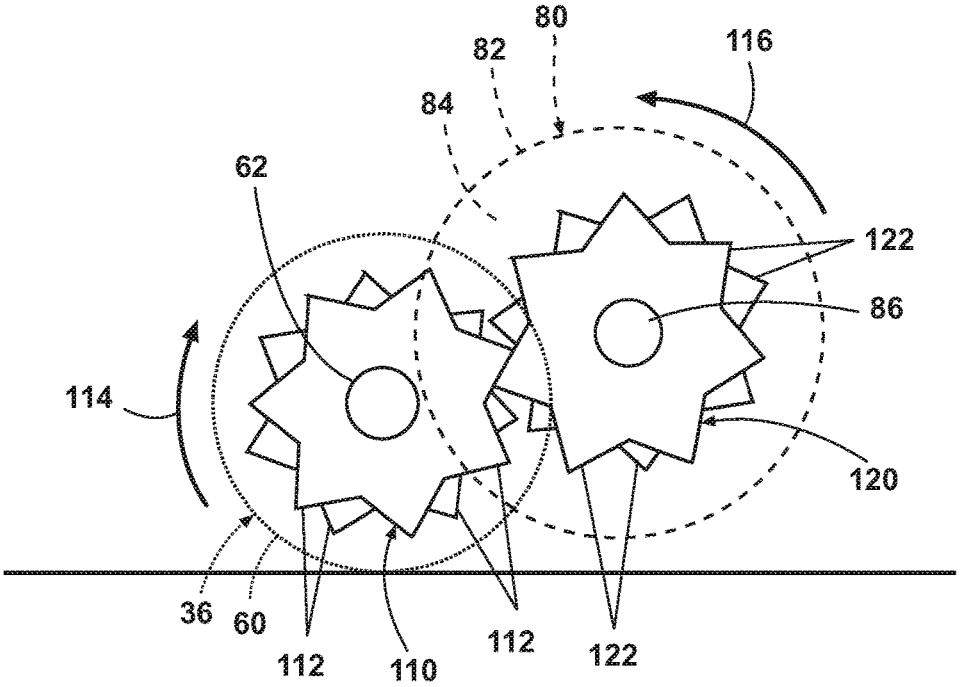
FIG. 3 is a schematic diagram of the gear drive mechanism of a rear wheel and rotating magnetic drum of the magnetic cleaning apparatus of FIG. 2A and 2B.

FIG. 3 is a schematic diagram of the gear drive mechanism of the rear wheel and rotating magnetic drum 80 of the foot assembly 30 of FIGS. 2A and 2B. A rear wheel gear 110 comprising a plurality of teeth 112 is mechanically connected to the rear wheel 36 sharing the same axis of rotation and mounting 62 as the rear wheel 36. A magnetic drum drive gear 120 comprising a plurality of teeth 122 is mechanically connected to the magnetic drum 80 sharing the same axis of rotation and mounting 86 as the magnetic drum 80 and meshes with the teeth 112 of the rear wheel gear 110. Therefore, when the rear wheel 36 rotates in the direction 114, corresponding to translation of the magnetic cleaner 10 in the forward direction, the rear wheel gear rotates in the same direction 114 causing rotation of the magnetic drum drive gear 120 and thereby the magnetic drum 80 in the opposite direction 116.

The housing 32 of the foot assembly 30 can be formed using thermoplastic materials such as polypropylene, acrylonitrile butadiene styrene (ABS), or polycarbonate, for example, by injection molding methods. Alternatively, the housing 32 may be formed with metal or any other material that can provide adequate strength and durability. Similarly, the removable dirt cup 74, the cleaning particle reservoir 50, the rear wheels 36, the front wheels 34, the agitator hub 72, the cleaning particle dispenser 38, and the agitator holder 68 can be formed with thermoplastic materials by injection molding.

The ferromagnetic cleaning particle reservoir 50 may, in addition to the ferromagnetic cleaning particles 54 contain materials to prevent agglomeration of the ferromagnetic cleaning particles 54 prior to dispensing. Moisture can cause such agglomeration and can be countered with hygroscopic or desiccant materials to maintain granularity of the ferromagnetic cleaning particles 54. Such desiccant materials may be any known type such as silica gel packs or salt. Desiccant materials disposed within the ferromagnetic cleaning particle reservoir 50 may be attached to the inside walls of the cleaning particle reservoir 50 to ensure that the desiccant does not interfere with the dispersing of the cleaning particles 54.

Additionally, the cleaning particle reservoir 50 may vibrate while the magnetic cleaner 10 is translated over the surface to be cleaned 100 to further maintain granularity of the ferromagnetic cleaning particles 54. Vibration may be imparted through the magnetic cleaner 10 by mechanical linkages to either the front 34 or rear 36 wheels. For example, vibration may be induced during forward translation, backward translation, or both forward and backward translation of the magnetic cleaner 10 over the surface to be cleaned 100.

The ferromagnetic cleaning particle dispenser 38 can have a rotating mechanism comprising a disk with fins such as those found in broadcast spreaders for lawn care. The rotating disk with fins mechanism may impart energy to agglomerated ferromagnetic cleaning particles 54 to disaggregate them just prior to disbursement through the ferromagnetic cleaning particle dispenser 38. Alternatively, the rotating disk with fins mechanism may provide a nozzle exit velocity in the horizontal direction to allow a wide disbursement of the ferromagnetic cleaning particles. The rotation of the disk with fins mechanism can be by mechanical linkage to either the front 34 or rear 36 wheels by any known way such as gears or belt drives and the like.

The ferromagnetic cleaning particle dispenser 38 can further have a dispenser for wide dispersal of the ferromagnetic cleaning particles 54 by entraining the ferromagnetic cleaning particles 54 in an air stream. The air stream may be provided by a fan disposed in or near the ferromagnetic cleaning particle reservoir 50 to entrain the ferromagnetic cleaning particles 54 contained therein. The fan may be driven by mechanical coupling to either the front 34 or rear wheel 36 by any known method, such as by drive gears or drive belts. Additionally, there may be a one way clutch in the mechanical coupling of the fan to the front 34 or rear wheels 36 to only allow the fan to rotate in a direction to provide an air stream out of the ferromagnetic cleaning particle dispenser 38. The ferromagnetic cleaning particles 54 entrained in an air stream may be released through an orifice in the ferromagnetic cleaning particle dispenser 38 to control the flow rate of the air stream.

The ferromagnetic cleaning particle dispenser 38 may further be configured such that the rate of ferromagnetic cleaning particle 54 distribution can be controlled, for example by having a distribution orifice with a selectable diameter. Such functionality enables the user to select the level of distribution of ferromagnetic cleaning particles 54 based upon how dirty the surface to be cleaned 100 is or based on the depth of a fabric or rug when the surface to be cleaned 100 is a fabric or rug. The distribution of ferromagnetic cleaning particles 54 may also be selectively turned off, for example by capping off the ferromagnetic cleaning particle dispenser 38. Being able to selectively turn off ferromagnetic cleaning particle 54 distribution allows the user to not distribute ferromagnetic cleaning particles 54 near the end of the magnetic cleaning process on every back stroke, ensuring that substantially all the ferromagnetic cleaning particles 54 are removed from the surface being cleaned 100.

The bristles 73 of the agitator assembly 40 can be secured to the agitator hub 72 via mechanical fasteners such as conventional staples, or by an alternate attachment commonly known in the art such as adhesive, insert molding, overmolding, or the like. The bristles 73 can comprise nylon, or natural fibers such as animal hairs. Alternatively, the bristles 73 can comprise elastomeric materials like silicone. The bristles 73 can be arranged in a pattern of bristle 73 tufts that extend outwardly from the agitator hub 72. The bristles 73 can be secured to the agitator hub at a slight angle relative to vertical to enhance contact and agitation of the surface being cleaned 100. Ideally the bristles 73 are stiff enough to agitate the cleaning particles 54 to promote agglomeration with dirt on the surface to be cleaned 100, yet flexible enough that the bristles 73 will not damage the surface to be cleaned 100 or any other items that might come in contact with the agitator assembly 40.

The agitator assembly 40 can also vibrate while the magnetic cleaner 10 is translated over the surface to be cleaned 100. Such vibration may be caused by the agitator holder 68 being mechanically linked to the either the front 34 or rear wheels 36 by a known way such as drive gears or drive belts and the like.

The agitator assembly 40 can further comprise an oscillating magnetic field. The field may be produced by, for example, a static or rotating magnet disposed in the agitator hub 72 or the agitator holder 68 to effect magnetic agitation of the ferromagnetic cleaning particles 54. Alternatively, there can be a battery powered electromagnet with electronics to provide an oscillating magnetic field. A combination magnetic and mechanical agitation of the ferromagnetic cleaning particles 54 can cause the ferromagnetic cleaning particles 54 to move in longer and more complex paths prior to collection by the magnetic drum 80, thereby increasing the probability of each of the ferromagnetic cleaning particles 54 coming in contact with dirt and therefore agglomerating with dirt. As a further alternative a magnet for magnetic agitation may be disposed on the housing 32 of the foot assembly 30.

The magnetic drum 80 comprises a magnetic drum surface 82 emanating a magnetic field. The magnetic field can be produced via a single permanent magnet of cylindrical shape or a plurality of bar shaped magnets disposed along the length of the drum surface 82. Alternatively, one or more permanent magnets may be affixed to the inside of the magnetic drum 80 and may not be on the drum surface 82. By having the magnets within the magnetic drum 80 rather on the surface 82, the surface may be formed from non-magnetic materials, such as materials that are sticky or materials that can hold a high level of electrostatic charge, so that dust can be attracted to the magnetic drum 80 by ways other than magnetism. When a plurality bar magnets are disposed on or within the magnetic drum, the magnets can be orientated such that the ends of the bar magnets on any given side of the magnetic drum 80 have alternating polarity. For example, the North Pole of one magnet may be adjacent the South Poles of two other magnets. By alternating polarity, the ferromagnetic cleaning particles 54 can be slightly magnetized and oriented in a manner such that they may be repelled by one of the bar magnets and are attracted by adjacent bar magnets as the magnetic drum 80 rotates. As a further alternative, the drum 80 may be comprised of one or more electromagnets energized by AC facility power, disposable batteries, or rechargeable batteries.

Figure 4:
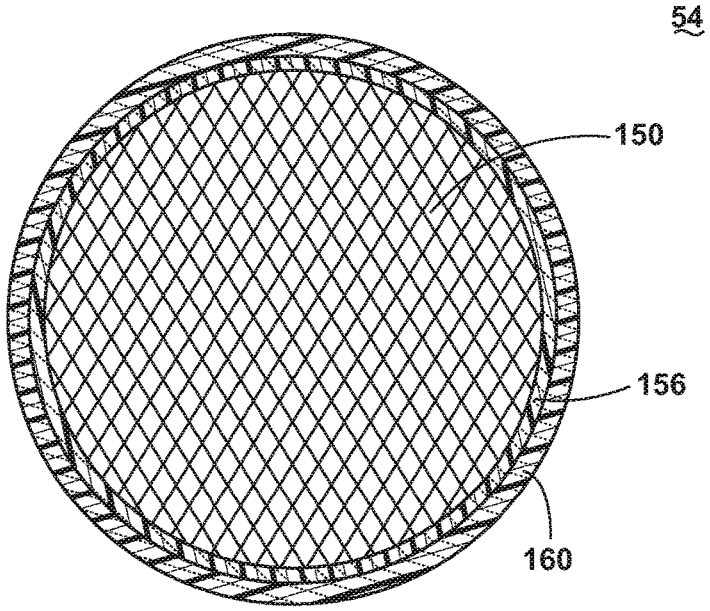
FIG. 4 is a cross-sectional view of a magnetic particle for use with the magnetic cleaner of FIG. 1.

FIG. 4 is a schematic diagram of a ferromagnetic cleaning particle 54 for use with the magnetic cleaner 10 of FIG. 1. The ferromagnetic cleaning particle 54 comprises a ferromagnetic core 150, with a corrosion resistant layer 156 disposed thereon, and a cleaning agent coating layer 160 disposed on the corrosion resistant layer 156. The ferromagnetic core 150 provides for the attractive force between the ferromagnetic cleaning particle 54 and the magnetic drum 80. The corrosion resistant layer 156 prevents corrosion, such as oxidation, of the ferromagnetic core 150 by reacting with humid ambient air that may come in contact with the ferromagnetic core 150 or by reacting with the cleaning agent coating layer 160.

The ferromagnetic cleaning particle 54 can be between about 20 to 5000 microns in diameter, and more preferably between 500 and 2000 microns in diameter. Although the ferromagnetic cleaning particle 54 is shown as a spherical, it can be any shape including, but not limited to, ellipsoidal, trapezoidal, pyramidal, rectangular box, cylindrical, frusto-conical, irregular, or any combinations thereof. In fact, non-round shapes of the ferromagnetic cleaning particles 54 may enhance cleaning of the surface 100, by being more effective in penetrating rugs and fabrics. The ferromagnetic core 150 may be fabricated with any known ferromagnetic materials that display magnetic order, including, but not limited to iron, nickel, cobalt, chromium, manganese, intermetallics, oxides, or alloys of the proceeding materials, or combinations thereof.

The corrosion resistant layer 156 can be any layer that adheres to the ferromagnetic core 150 reliably and can provide resistance to reaction with the overlying cleaning agent coating layer. The corrosion resistant layer 156 can be a metal, ceramic or plastic layer deposited on the ferromagnetic core by any known method, such as electroless plating, spray painting, or by otherwise translating the ferromagnetic core 150 through an aerosolized mist of the corrosion resistant layer 156 material. Alternatively, the corrosion resistant layer can be omitted if the ferromagnetic core comprises certain ferritic grades of stainless steel.

The cleaning agent coating layer 160 can be a chemical solvent or an adhesive material or a combination of the two types. As a solvent material, the cleaning agent coating layer 160 can absorb dirt into solution. As such, the dirt dissolved in the agent coating layer 160 is removed as the dirt laden ferromagnetic cleaning particle 54 is collected by the magnetic drum 80 and stored in the removable dirt cup 74. As an adhesive material, dirt that comes in contact with the ferromagnetic cleaning particle 54 can adhere to the cleaning agent coating layer 160. As such, the dirt adhering to the cleaning agent coating layer 160 is removed as the dirt laden ferromagnetic cleaning particle 54 is collected by the magnetic drum 80 and stored in the removable dirt cup 74. An adhesive material for the cleaning agent coating layer 160 may be any type of material with a high coefficient of static friction, such as rubber, resins, glues, or the like. A solvent material for the cleaning agent coating layer 160 may be any type of coating infused with solvents or chemicals such as water, mineral spirits, alcohols, surfactants, and chelating agents. Further examples of the cleaning coating layer may include an anionic surfactant, arclay or similar clay materials, sticky silicone gel, removable polymer adhesive, or adsorbent foam or cellulose sponge holding typical carpet cleaning surfactants. As a further alternative, the cleaning agent coating layer may be comprised of material that can maintain an electrostatic charge, such as an electrically insulative material. Such a layer can promote adhesion of dirt from the surface to be cleaned 100 to the ferromagnetic cleaning particle 54 by electrostatic adhesion. Optionally, the ferromagnetic cleaning particles 54 with an insulative cleaning agent coating layer 160 can be electrostatically charged prior to dispersing on to the surface to be cleaned 100. An example of such electrostatic charging of particles is disclosed in U.S. Pat. No. 6,761,773, which is incorporated herein by reference in its entirety.

A collection of ferromagnetic cleaning particles 54 comprising a cleaning powder dispersed through the ferromagnetic cleaning particle dispenser 38 may have additives other than the ferromagnetic cleaning particles 54 contained therein. In particular, there may be additives to prevent clumping or agglomeration of the ferromagnetic cleaning particles 54. Such anti-agglomeration additives may also comprise ferromagnetic materials, so that the anti-agglomeration additives can also be removed from the surface being cleaned 100 using magnetic attractive forces.

In another embodiment, the ferromagnetic cleaning particle 54 can be a composite material of a porous ceramic core with ferromagnetic material within the ceramic core. This can be a porous ceramic structure that is doped with magnetic materials. The porous ceramic can further hold known cleaning solutions within its pores.

The used ferromagnetic cleaning particles 54 can further be collected in the removable dirt cup 74 and reused. The reuse and recycling of the cleaning particles 54 may involve preparing the cleaning particles 54 for reuse. For example, this may involve washing the ferromagnetic cleaning particles 54 in a solvent such as water and drying prior to reuse. After washing and drying the ferromagnetic cleaning particles 54, the particles may need to be shaken or tumbled, for example in a tumbler (not shown) to prevent agglomeration and restore granularity of the washed ferromagnetic cleaning particles 54.

As another example, the ferromagnetic cleaning particle 54 may be dipped in a cleaning solution or reconstitution solution to reconstitute the cleaning agent coating layer 160. The reconstitution of the cleaning agent coating layer may be performed after washing the ferromagnetic cleaning particle 54 with a solvent such as water to remove used cleaning agent coating layer 160. Alternatively, the reconstitution of the cleaning agent coating layer 160 may be performed without washing and drying the ferromagnetic cleaning particle 54 such that a virgin cleaning agent coating layer 160 is deposited on top of the used cleaning agent coating layer 160. The reconstitution of the cleaning agent coating layer may be performed by the consumer or can be performed in larger volumes by a recycling operation or the manufacturer of the ferromagnetic cleaning particles 54.

As a further alternative, the cleaning agent can be used for a predetermined number of times before preparation for reuse. In yet another alternative, the ferromagnetic cleaning particle 54 can be reconstituted a predetermined number of times before disposal.

In the foregoing discussion, dirt is used generally as the material that is being removed from the surface to be cleaned. Dirt can include dust, debris, organic or inorganic particles, including human and animal based debris such as dead skin cells and hair. The surface to be cleaned can include any surface including floors, fabrics, and rugs. However, the magnetic cleaner 10 described is particularly suited for cleaning fabrics and rugs.

While the invention has been specifically described in connection with certain specific embodiments thereof, it is to be understood that this is by way of illustration and not of limitation, and the scope of the appended claims should be construed as broadly as the prior art will permit. The illustrated magnetic cleaner is but one example of the variety of magnetic cleaners with which this invention or some slight variant can be used. While shown and described for use with an upright or "stick"-type magnetic cleaner, the invention described herein can be used with any type of magnetic cleaner, such as robotic magnetic cleaners or hand-held magnetic cleaners. Reasonable variation and modification are possible within the forgoing disclosure and drawings without departing from the scope of the invention which is defined by the appended claims. It should also be noted that all elements of all of the claims can be combined with each other in a possible combination, even if the combinations have not been expressly claimed.

What is claimed is:

1. A magnetic cleaner comprising:

a housing comprising a handle assembly;

a ferromagnetic cleaning particle dispenser for dispersing ferromagnetic cleaning particles from a front of the housing onto a surface to be cleaned;

a ferromagnetic cleaning particle reservoir coupled to the ferromagnetic cleaning particle dispenser to selectively supply the ferromagnetic cleaning particle dispenser with ferromagnetic cleaning particles;

a mechanical agitator comprising at least one agitator brush having multiple bristles tufted to a hub for mechanically agitating the ferromagnetic cleaning particles dispersed onto the surface to be cleaned;

a magnetic agitator for magnetically agitating the ferromagnetic cleaning particles dispersed onto the surface to be cleaned, wherein the magnetic agitator comprises at least one magnet producing an oscillating magnetic field to effect magnetic agitation of the ferromagnetic cleaning particles;

a rotating magnetic drum emanating a magnetic field for attracting the ferromagnetic cleaning particles from the surface to be cleaned back to the magnetic cleaner; and a dirt cup for collecting the ferromagnetic cleaning particles attracted by the rotating magnetic drum;

wherein the at least one magnet is a static or rotating magnet disposed in the hub to effect magnetic agitation of the ferromagnetic cleaning particles.

2. The magnetic cleaner of claim 1, further comprising a motor rotatably coupled with the at least one agitator brush through a connector for rotation of the at least one agitator brush.

3. The magnetic cleaner of claim 2 wherein the at least one agitator brush is rotatable around a vertical axis.

4. The magnetic cleaner of claim 1 wherein the housing comprises a foot assembly coupled with the handle assembly, wherein at least the ferromagnetic cleaning particle dispenser and the mechanical agitator are provided on the foot assembly.

5. The magnetic cleaner of claim 4 wherein the handle assembly is pivotally mounted to the foot assembly by a swivel joint.

6. The magnetic cleaner of claim 4 wherein the foot assembly comprises wheels for translating the magnetic cleaner over a surface to be cleaned.

7. The magnetic cleaner of claim 6, further comprising a gear drive mechanism coupling the rotating magnetic drum and at least one of the wheels.

8. The magnetic cleaner of claim 7 wherein the gear drive mechanism comprises a rear wheel gear connected to the at least one of the wheels and a magnetic drum drive gear connected to the rotating magnetic drum and meshing with the rear wheel gear.

9. The magnetic cleaner of claim 6 wherein at least one of the wheels comprises an axle rotatably mounting the at least one of the wheels to the housing, and wherein the axle is received within a slot on the housing to enable the at least one of the wheels to translate forwardly and rearwardly along the slot depending on the direction of movement of the magnetic cleaner.

10. The magnetic cleaner of claim 9 wherein the rotating magnetic drum is mechanically coupled with the at least one of the wheels to rotate the rotating magnetic drum with the at least one of the wheels.

11. The magnetic cleaner of claim 1, further comprising a scraper mounted to the housing proximate the rotating magnetic drum for scraping the ferromagnetic cleaning particles from the rotating magnetic drum as the rotating magnetic drum rotates.

12. The magnetic cleaner of claim 11 wherein the rotating magnetic drum is mounted on a drum mount for rotation within a slotted drum mount hub on the housing to enable the rotating magnetic drum to translate toward and away from the scraper, depending on the direction of movement of the magnetic cleaner.

13. The magnetic cleaner of claim 1 wherein the dirt cup is removable from the housing and comprises a hand grip to enable separation of the dirt cup from the housing for emptying the dirt cup.

14. The magnetic cleaner of claim 1 wherein the ferromagnetic cleaning particle reservoir comprises a vibrating cleaning particle reservoir.

15. The magnetic cleaner of claim 1 wherein the magnetic cleaner is configured to dispense particles from the ferromagnetic cleaning particle dispenser when the magnetic cleaner is moved in a rearward direction, but not a forward direction, and wherein the magnetic cleaner is configured to collect the ferromagnetic cleaning particles attracted by the rotating magnetic drum in the dirt cup when the magnetic cleaner is moved in the forward direction, but not the rearward direction.

16. The magnetic cleaner of claim 15 wherein the mechanical agitator agitates the ferromagnetic cleaning particles when the magnetic cleaner is moved in the forward direction, but not the rearward direction.

* * * * *